US007687215B2

(12) United States Patent
Mang et al.

(10) Patent No.: US 7,687,215 B2
(45) Date of Patent: Mar. 30, 2010

(54) TONER ADDITIVES

(75) Inventors: Mark E. Mang, Rochester, NY (US); Hui Chang, Pittsford, NY (US); Gerald P. Cox, Brockport, NY (US); Joseph L. Leonardo, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 490 days.

(21) Appl. No.: 11/254,949

(22) Filed: Oct. 20, 2005

(65) Prior Publication Data

US 2007/0092825 A1 Apr. 26, 2007

(51) Int. Cl.
*G03G 9/087* (2006.01)

(52) U.S. Cl. ..... 430/109.3; 430/108.1; 430/109.4; 430/137.18; 430/137.2

(58) Field of Classification Search ..... 430/137.18, 430/137.19, 137.2, 108.1, 109.3, 109.4
See application file for complete search history.

(56) References Cited

U.S. PATENT DOCUMENTS 4,894,308 A 1/1990 Mahabadi et al.
5,514,763 A * 5/1996 Kmiecik-Lawrynowicz et al. ..... 526/340
5,854,367 A * 12/1998 Salvetat et al. ..... 526/347.1
5,972,547 A * 10/1999 Yaguchi et al. ..... 430/45.1
6,080,519 A * 6/2000 Ishiyama et al. ..... 430/110.3
H1889 H * 10/2000 Lin et al. ..... 430/108.8
6,383,705 B2 * 5/2002 Aoki et al. ..... 430/109.4
6,475,690 B2 * 11/2002 Anno et al. ..... 430/108.8
6,582,865 B1 * 6/2003 Kameoka ..... 430/108.1
7,214,458 B2 * 5/2007 Mang et al. ..... 430/108.1
2005/0064311 A1 3/2005 Mang et al.
2006/0115758 A1 * 6/2006 Chang et al. ..... 430/109.4

OTHER PUBLICATIONS

Whelan, T., consultant, Polymer Technology Dictionary, Chapman & Hall, NY (1994), p. 256.*
Whelan, T., consultant, Polymer Technology Dictionary, Chapman & Hall, NY (1994), p. 209.*
U.S. Appl. No. 10/998,822, filed Nov. 30, 2004, Chang et al.

* cited by examiner

*Primary Examiner*—Janis L Dote
(74) *Attorney, Agent, or Firm*—Pillsbury Winthrop Shaw Pittman LLP

(57) ABSTRACT

The presently disclosed embodiments relate in general to toners for use in electrophotographic apparatuses, such as printers and copiers. More particularly, a toner formulation of at least one binder, at least one colorant, and an embrittling agent, and methods for making the same, is provided wherein the embrittling agent increases grinding rate of the toner formulation.

22 Claims, 3 Drawing Sheets

TONER ADDITIVES

BACKGROUND

The invention relates generally to the toners, and processes for making toners, useful in electrophotographic apparatuses. More particularly, the embodiments pertain to the addition of an embrittling agent to toner formulations to increase grinding rates.

Toner is commonly known as the "dry ink" for laser printers and copiers to form xerographic images on different substrates. It is typically comprised of a mixture of plastic resin, colorant and other toner ingredients and may be made mechanically, by grinding the ingredients into tiny particles. As xerographic processes become more advanced, the demand for high quality toner, comprising smaller particles, grows. Smaller particles are desirable because they provide sharper images as well as lower cost per image print.

However, the cost of producing toner with smaller particles by current technology can be very expensive. Most toner is made by "melt mixing" or "melt blending" the toner ingredients. For example, utilization of the extrusion process to prepare toner compositions is common. Extrusion is a continuous process that generally entails dry blending the toner ingredients, placing them into an extruder, melting and mixing the mixture, extruding the material, and reducing the extruded material to pellet form. The pellets are further reduced in size by grinding or jetting, and are then classified by particle size. A typical extrusion apparatus and process are described in U.S. Pat. No. 4,894,308, the disclosure of which is totally incorporated herein by reference. However, this process may sometimes be inexact and requires much energy. Further, the size produced varies throughout the grinding process and cannot be precisely controlled. To achieve particles that are uniform in size, the particles are mechanically sorted throughout the grinding process. Consequently, to achieve toner with average sized particles that are very small is expensive with traditional methods.

Although there are other methods of grinding that may be suitable for their intended purposes, such as for example, jetting where the strands are passed through the jets of an atomizer to break up the particles to the desired size, each method is generally energy intensive, and thus, costly.

SUMMARY

According to aspects illustrated herein, there is provided a toner, and methods of making toners, with properties that allow increases in grinding rates.

In particular, an embodiment of the present invention provides a process of making toner comprising: mixing at least one binder, at least one colorant and at least one embrittling agent to form a mixture, the embrittling agent being selected from the group consisting of an alpha-methyl styrene polymer, a styrene copolymer, and a hydrocarbon resin, extruding the mixture, and grinding the extruded mixture to form toner particles having an average particle size of from about 3 microns to about 13 microns. The colorant may be suspended in the medium and not necessarily dissolved, as in a solution.

An alternative embodiment provides a process of making toner comprising: mixing to form a toner formulation, the formulation comprising at least one binder, at least one colorant and at least one embrittling agent selected from the group consisting of an alpha-methyl styrene polymer, a styrene copolymer, and a hydrocarbon resin, grinding the toner formulation to form a generally uniform average particle size distribution having an average particle size of from about 3 microns to about 13 microns, and classifying the ground toner formulation.

Embodiments of the present invention also provides a toner formulation comprising: at least one binder, at least one colorant, and an embrittling agent, the embrittling agent being selected from the group consisting of an alpha-methyl styrene polymer, a styrene copolymer, and a hydrocarbon resin.

BRIEF DESCRIPTION OF THE DRAWINGS

For a better understanding of the present invention, reference may be had to the accompanying figures.

DETAILED DESCRIPTION

Figure 1:
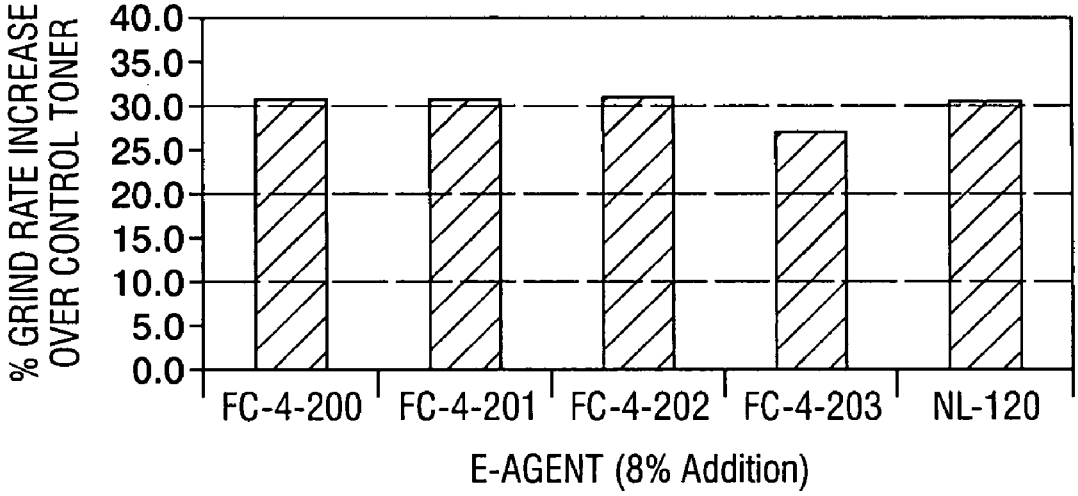
FIG. 1 is a graph illustrating the increase in grind rate of 5090 toner with an embrittling agent in comparison to 5090 toner without an embrittling agent.

In the following description, reference is made to the accompanying drawings, which form a part hereof and which illustrate several embodiments of the present invention. It is understood that other embodiments may be utilized and structural and operational changes may be made without departure from the scope of the present invention.

Generally, the process of electrophotographic printing includes charging a photoconductive member to a substantially uniform potential to sensitize the surface thereof. The charged portion of the photoconductive surface is exposed to a light image from, for example, a scanning laser beam, a light emitting diode (LED) source, etc., or an original document being reproduced. This records an electrostatic latent image on the photoconductive surface of the photoreceptor. After the electrostatic latent image is recorded on the photoconductive surface, the latent image is developed.

In embodiments of the present invention, any known type of image development system may be used in an image developing device, including, for example, magnetic brush development, jumping single-component development, hybrid scavengeless development (HSD), etc. These development systems are well known in the art, and further explanation of the operation of these devices to form an image is thus not necessary herein. Once the image is formed with toners/developers of the invention via a suitable image development method such as any one of the aforementioned methods, the image is then transferred to an image receiving medium such as paper and the like. In an embodiment of the present invention, it is desired that the toners be used in developing an image in an image-developing device utilizing a fuser roll member. Fuser roll members are contact fusing devices that are well known in the art, in which heat and pressure from the roll are used in order to fuse the toner to the image-receiving medium. Typically, the fuser member may be heated to a temperature of from about 125° C. to about 200° C.

According to embodiments of the present inventions toner particles may be made by melt mixing, melt blending, or otherwise mixing each of the toner components with a colorant, such as a pigment or dye, as well as other optional additives, such as charge carrier additives, surfactants, emulsifiers, pigment dispersants, flow additives, and the like. The optional additives may be included to facilitate toner processing or enhance the produced toner properties. The resulting product can be subjected to grinding, kneading, milling, or the like, to form toner particles. If desired, waxes with a low molecular weight, e.g., of from about 500 to about 20,000, such as polyethylene, carnauba polypropylene, and paraffin waxes, may be included in or on the toner, as for example, fusing release agents.

The present embodiments relate to a process for making toner that is more cost effective than traditional methods. The grinding step is one of the most energy intensive stages of toner manufacturing. Generally, large and expensive equipment is needed to properly perform the grinding and reduce the toner particles to a desired size. By adding embrittling agents to a toner formulation, the grinding rate in toner preparation is increased significantly and thus manufacturing costs are lowered. Furthermore, the increase in grinding rate does not cause any substantial detrimental effect on the xerographic and fusing performance of the toner. Thus, the increase in grinding rate lowers the overall cost of toner manufacturing, by lessening the required amount of energy in the grinding, without negatively impacting the quality of toner performance.

U.S. patent application Ser. No. 10/998,822, filed Nov. 30, 2004, entitled "Toner Including Amorphous Polyester, Crosslinked Polyester and Crystalline Polyester," incorporated herein by reference in its entirety, describes a toner comprised of a binder and at least one colorant, wherein the binder further comprises polyester materials that provide improved toner performance and may include additives such as embrittling agents.

U.S. patent application Ser. No. 10/650,553, filed Aug. 28, 2003, entitled "Toner Compositions," which was published on Mar. 24, 2005, as Application Publication No. 2005/0064311, also incorporated herein by reference in its entirety, describes a toner and developer compositions that include a compatibilizer that can function as an embrittling agent.

In particular, according to embodiments of the present invention, several materials are being introduced as embrittling agents for extruded toner. For example, alpha-methyl styrene polymers, styrene copolymers, and hydrocarbon resins have all demonstrated increased grinding rates when incorporated into toner formulations. For example, adding at least one embrittling agent to a toner formulation exhibited increased grinding rates of the toner particles by about 10 percent to about 100 percent. Although use of embrittling agents for toners are known, the use of these particular materials as agents have demonstrated unexpected results. For example, the addition of these easily friable resins in specific amounts increased the grinding rate exponentially. For example, the addition of the friable resins in amounts of 8% exhibited increased grinding rate of toner by 27% or more. In embodiments, addition of embrittling agents to specific toners increased the grinding rate from 27% to 40%, relative to a control toner. The embrittling agents make possible the further reduction of toner to a generally uniform particle size than would be obtained from grinding without embrittling agents. In addition, some of these novel embrittling agents are water white (or clear) and thus do not affect toner color. These embrittling agents can also be of both high and low molecular weights which may help affect hot offset during fusing of the image.

In an embodiment of the invention, the colorant is melt mixed with a medium that includes such embrittling agents described above. Various suitable colorants of any color without restriction can be employed in toners of the invention, for example carbon black, magnetite, or mixtures thereof, cyan, magenta, yellow, blue, green, red, orange, violet or brown, or mixtures thereof, including suitable colored pigments, dyes, and mixtures thereof including Carbon Black, such as REGAL 330 carbon black (Cabot), Acetylene Black, Lamp Black, Aniline Black, Diarylide Yellow, SUNFAST YELLOW, POLYTONE YELLOW, Arylide Yellow, Chrome Yellow, Zinc Yellow, SICOFAST YELLOW, SUNBRITE YELLOW, LUNA YELLOW, NOVAPERM YELLOW, Chrome Orange, BAYPLAST ORANGE, Cadmium Red, LITHOL SCARLET, Rubines, Quanacridones, RHODAMINE LAKE C, SUNTONE MAGENTA, POLYTONE MAGENTA, HOSTAPERM RED, FANAL PINK, HOSTAPERM PINK, LITHOL RED, RHODAMINE LAKE B, Brilliant Carmine, SUNTONE CYAN, POLYTONE CYAN, HELIOGEN BLUE, HOSTAPERM BLUE, NEOPAN BLUE, PV FAST BLUE, Phthalocyanine Blue, CINQUASSI GREEN, HOSTAPERM GREEN, titanium dioxide, cobalt, nickel, iron powder, SICOPUR 4068 FF, and iron oxides such as MAPICO BLACK (Laporte Pigments, Inc.), NP608 an NP604 (Northern Pigment), BAYFERROX 8610 (Bayer), MO8699 (Mobay), TMB-100 (Magnox), mixtures thereof and the like. This list is not exhaustive, and any colorant or combination of colorants may be used without restriction. The colorant is preferably incorporated in an amount of at least about 2% by weight of the toner, preferably about 4% by weight to about 30% by weight of the toner, exclusive of any surface additives. The weight percentage of the colorant refers to the actual weight percentage of the pigment or dye only, and not to any weight from binder or other components possibly added along with the colorant.

In embodiments, the embrittling agent increases the grinding rate of the produced toner particles so that average toner particle sizes achieved is from about 3 microns to about 13 microns, or from about 5 microns to about 12 microns, as compared to the same toner particles having an equivalent average toner particle size and without any embrittling agent added. The embrittling agent may be present in the toner formulation in an amount from about 1 to about 20 percent by weight of the toner. In an alternative, the agent may be present in an amount of from about 4 to about 15 percent by weight of the toner, or from about 6 to about 10 percent by weight of the toner. In yet another embodiment, the embrittling agent is present in an amount of 8 percent by weight of the toner.

In other embodiments, a process for making a toner may include mixing a toner formulation that has at least one colorant, a medium, and at least one embrittling agent. The medium may comprise a resin, a liquid, or a solvent. The mixture is further ground or dispersed to achieve generally uniform particle distribution having a generally small average particle size, and the embrittling agent that increases the rate at which the toner formulation grinds, helps facilitate the achievement of the desired average particle size. Further included in the process may be classifying the ground toner particles to a narrower particle size distribution. Classification can separate the collection or particles into two or more portions, allowing removal of the fines portion from the collection.

Additionally, incorporation of these embrittling agents into low-melt toners enables use of crystalline polyester technology. It has been found that as a result of the inclusion of crystalline polyester material, the strength of the toner is improved. However, because of the increased strength, the grinding needed to achieve the desired toner particle size and homogeneity has to be conducted longer and/or more intensely. Thus, although crystalline polyester provides good fusing benefits, it makes the toner difficult to grind. By adding the embrittling agent, the low-melt toner is able to keep the fusing benefits and still increase or maintain an acceptable grinding rate.

Among the materials tested as embrittling agents, several demonstrated significant ability to increase grinding rate and without adversely affecting fuser fix or other toner performances. Alpha-methyl styrene/styrene copolymers used as embrittling agent resin types include, but are not limited to, FTR2120 resin (an α-Methylstyrene/Styrene copolymer), FTR2140 resin (an α-Methylstyrene/Styrene copolymer), FTR6125 resin (a Styrene monomer/Aliphatic monomer copolymer), and FMR0150 resin (a Styrene monomer/Aromatic monomer copolymer). These copolymers can be obtained from Mitsui Chemicals, Inc. Three other types of resin were obtained from Neville Chemical Company, Pittsburg, Pa. and include, but are not limited to, FT-11-83 resin (a hydrocarbon), FT-11-126 (a hydrocarbon), and FT-11-130 (a hydrocarbon).

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

EXAMPLES

The examples set forth hereinbelow and are illustrative of different compositions and conditions that can be used in practicing the invention. All proportions are by weight unless otherwise indicated. It will be apparent, however, that the invention can be practiced with many types of compositions and can have many different uses in accordance with the disclosure above and as pointed out hereinafter.

Example I

Materials

Five samples of various resin types were obtained from Neville Chemical Company, Pittsburgh, Pa.

1. FC-4-200 resin: a phenol-modified, multi-purpose hydrocarbon resin.

FC-4-200 Resin

| Physical Properties | Typical Properties | Specifications |
|---|---|---|
| Softening Point, R&B ° C. (ASTM E-28)* | 140 | 140 ± 5 |
| Color Gardner (50% in 100 Solvent) (ASTM D-1544)* | 12 | 14 Maximum |
| Acid Number (Modified ASTM D-974)* | <1 | — |
| Flash Point ° F. (COC) (ASTM D-92)* | 520 | — |
| Specific Gravity at 25° C. (ASTM D-71)* | 1.078 | — |
| Iodine No. Wijs (ASTM D-1959)* | 130 | — |
| Hydroxyl Value (ASTM D-1957)* | 39 | — |
| Molecular Weight, no avg. GPC (ASTM D-3536)* | 655 | — |

-continued

FC-4-200 Resin

| Physical Properties | Typical Properties | Specifications |
|---|---|---|
| Viscosity at 25° C., bbl. sec., 50 wt. % resin in MAGIESOL 47 Oil[1] (ASTM D-1545)* | 6 | — |
| Form | Flaked | — |

*Referenced Test Method

[1]Magiesol 47 Oil is a product of Magie Bros. Oil Co., Div. Pennzoil Products Co.

2. FC4-201 resin: an alkylated aromatic hydrocarbon resin.

FC-4-201 Resin

| Physical Properties | Typical Properties | Specification |
|---|---|---|
| Softening Point, R&B ° C. (ASTM E-28)* | 140 | 140 ± 5 |
| Color Gardner (50% in 100 Solvent) (ASTM D-1544)* | 11 | 14 Maximum |
| Specific Gravity at 25° C. (ASTM D-71)* | 1.08 | — |
| Iodine No. Wijs (ASTM D-1959)* | 130 | — |
| Flash Point ° F. (COC) (ASTM D-92)* | 520 | — |
| Molecular Weight, no avg. GPC (ASTM D-3536)* | 770 | — |
| Form | Flaked | — |

*Referenced Test Method

3. FC-4-202 resin (or LX-2600 resin): a low molecular weight, inert thermoplastic hydrocarbon resin formulated to a high aromatic content.

FC-4-202 Resin

| Physical Properties | Typical Properties | Specification |
|---|---|---|
| Softening Point, R&B ° C. (ASTM E-28)* | 140 | 140 ± 5 |
| Color Gardner (50% in 100 Solvent) (ASTM D-1544)* | 14 | 15 Maximum |
| Specific Gravity at 25° C. (ASTM D-71)* | 1.11 | — |
| Iodine No. Wijs (ASTM D-1959)* | 145 | — |
| Flash Point ° F. (COC) (ASTM D-92)* | 510 | — |
| Molecular Weight, no avg. GPC (ASTM D-3536)* | 520 | — |
| Form | Flaked | — |

*Referenced Test Method

4. FC-4-203 resin: a low molecular weight, extremely soluble, thermally produced hydrocarbon resin.

FC-4-203 Resin

| Physical Properties | Typical Properties |
|---|---|
| Softening Point, R&B ° C. (ASTM E-28)* | 130-140 |
| Color Gardner (50% in 100 Solvent) (ASTM D-1544)* | 12 |

-continued

| FC-4-203 Resin | |
|---|---|
| Physical Properties | Typical Properties |
| Acid Number (Modified ASTM D-974)* | <1 |
| Flash Point ° F. (COC) (ASTM D-92)* | 500 |
| Specific Gravity at 25° C. (ASTM D-71)* | 1.109 |
| Form | Flaked |

*Referenced Test Method

5. NEVCHEM NL-120 resin: a thermoplastic hydrocarbon resin manufactured by the polymerization of cycloaliphatic and alkyl aromatic monomers.

| NEVCHEM NL 120 Resin | | |
|---|---|---|
| Physical Properties | Typical Properties | Specification |
| Softening Point, R&B ° C. (ASTM E-28)* | 120 | 120 ± 5 |
| Color Gardner (50% in 100 Solvent) (ASTM D-1544)* | 8.5 | 10 Maximum |
| Density at 25° C., g/cm$^3$ (ASTM D-70)* | 1.06 | — |
| Iodine No. Wijs (ASTM D-1959)* | 39 | — |
| Acid Value (ASTM D-1639)* | <1 | — |
| Form | Flaked | — |

*Referenced Test Method

Grinding Rate Study

The following toner formulation shown in Table 1 was used for the grinding study:

TABLE 1

| Toner Formulations | |
|---|---|
| Component | % by weight |
| Styrene Butadiene | 71.87 |
| Magnetite | 16.8 |
| Carbon black | 3.15 |
| distearyl dimethyl ammonium bisulfate and distearyl dimethyl ammonium methyl sulfate 2:1 ratio | 0.18 |
| Embrittling agent | 8 |

Toners were made by melt mixing the raw materials in Table 1 using an APV model MP2015 extruder available from APV Chemical Machines (Saginaw, Mich.). The operating conditions were a barrel temperature of 220° C., a throughput rate of 2 lb/hr, and a screw speed of 300 RPM. One toner was made for each of the above mentioned embrittling agents from Neville Chemical. The resulting toners were ground using an 0202 grinder available from Fluid Energy and Processing Equipment Company (Hatfield, Pa.). The grinding rates of the toners including these materials were compared to a control toner that is the same as the formulation in Table 1 with the exception of the 8% styrene butadiene resin being substituted for the embrittling agent. The results of the grinding study are shown in FIG. 1. This figure shows that all toners containing the assorted embrittling agents have approximately 30% faster grinding rate relative to the same formulation without the addition of the embrittling agent.

Example II

A pilot scale toner whose formulation is shown in Table 1 and the embrittling agent LX-2600 resin, available from Neville Chemical, was made in sufficient quantity using a Werner and Pfleiderer ZSK-40SC extruder. The raw materials were melt mixed in the extruder with a barrel temperature of 205° C., a screw speed of 500 RPM, and a throughput rate of 350 lb/hr. Water was injected at 1.6% by weight of the throughput rate and vacuum removed during extrusion. The resulting toner was ground in an Alpine AFG 200 fluidized bed grinder. After grinding it was classified using an ACUCUT Model B18 classifier to a volume median of about 9.25 microns by removal of the fine particles. Fine particles are those below 4 microns. The resulting toner was run in a XEROX DOCUTECH 5090 and XEROX DOCUTECH 6180 machines. Each machine was run for 100,000 prints. The results demonstrated that the addition of LX-2600 embrittling agent to the toner formulation had no adverse effect on toner performance and increased grinding rates during toner production. No adverse effect means that the toner ran in each machine as well as the current production toner without embrittling agent added. No adjustments were required to any of the machine subsystems to allow this toner to produce xerographic images.

Example III

Materials

The following table shows the embrittling agent and the amount used in the toner formulations used in this grinding rate study.

TABLE 3

| Embrittling agents used in grinding study (Slope ratio = normalized grind rate, higher is better) | | |
|---|---|---|
| E-Agent | E-Agent % | Slope Ratio |
| C9 | 0 | 2.83 |
| No FTR, No A3 | 0 | 1.00 |
| No e-agent | 0 | 0.85 |
| FTR-6125 | 6 | 0.93 |
| FMR | 6 | 1.16 |
| FTR-6125 | 14 | 1.10 |
| FMR | 14 | 1.33 |
| FTR-6125 | 10 | 1.06 |
| FMR | 10 | 1.17 |
| FTR-2120 | 6 | 1.03 |
| FTR-2140 | 6 | 1.05 |
| FTR-2120 | 14 | 1.40 |
| FTR-2140 | 14 | 1.52 |

Figure 2:
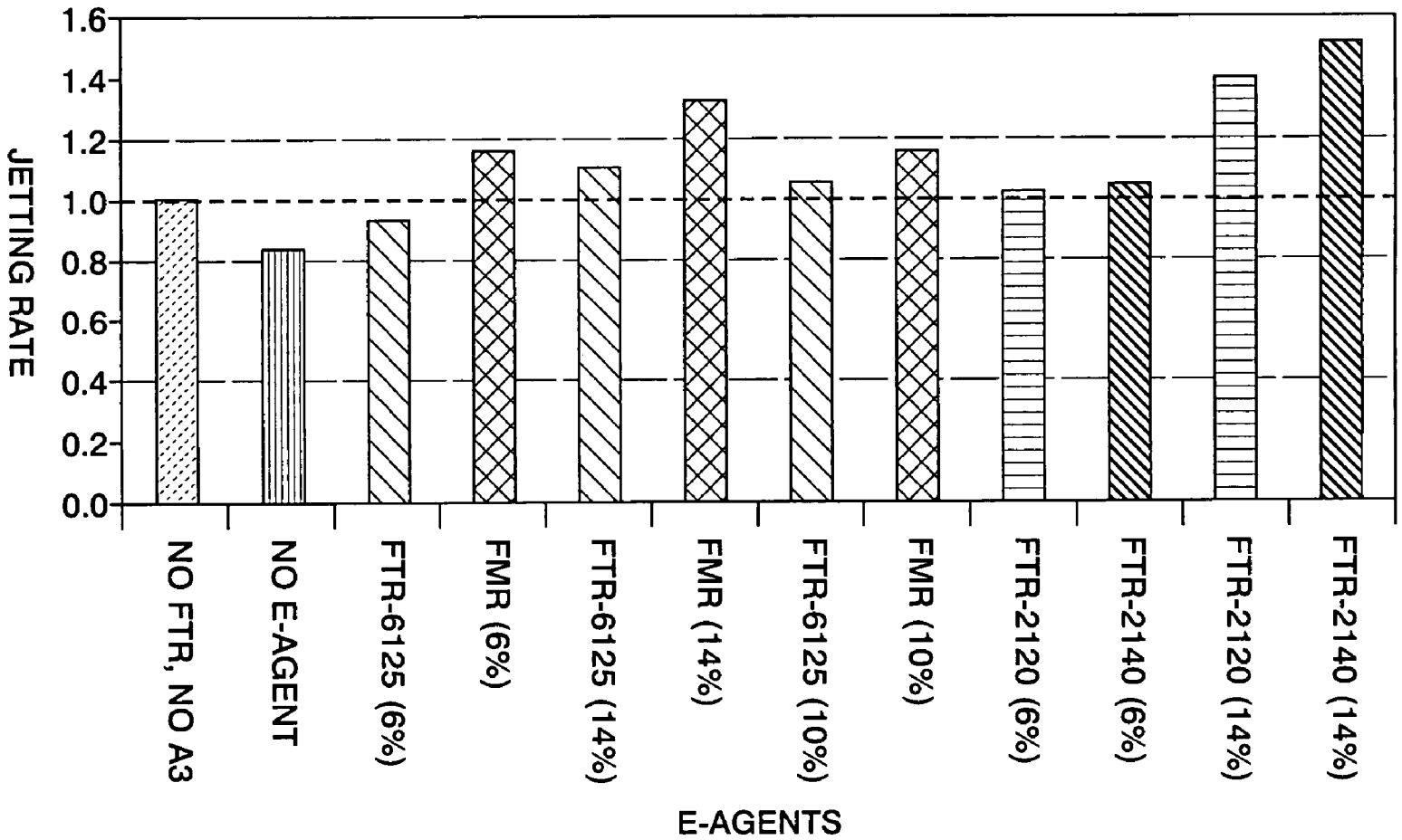
FIG. 2 is a graph illustrating the increase in grind rate of an Ultra Low Melt (ULM) IGEN3 toner with an embrittling agent in comparison to an ULM IGEN3 toner without an embrittling agent.

Toners were made with each of the above embrittling agents obtained from Mitsui Chemicals, Inc. The toners were ground using an 0202 grinder. The grinding rates of the toners made with these embrittling agents were compared to a control toner that has no crystalline polyester added and without any embrittling agent added. The results from the grinding study are shown in FIG. 2. Also an IGEN C9 standard toner for comparison has a jetting rate of 2.83.

Impact on Xerographic Performance

Figure 3:
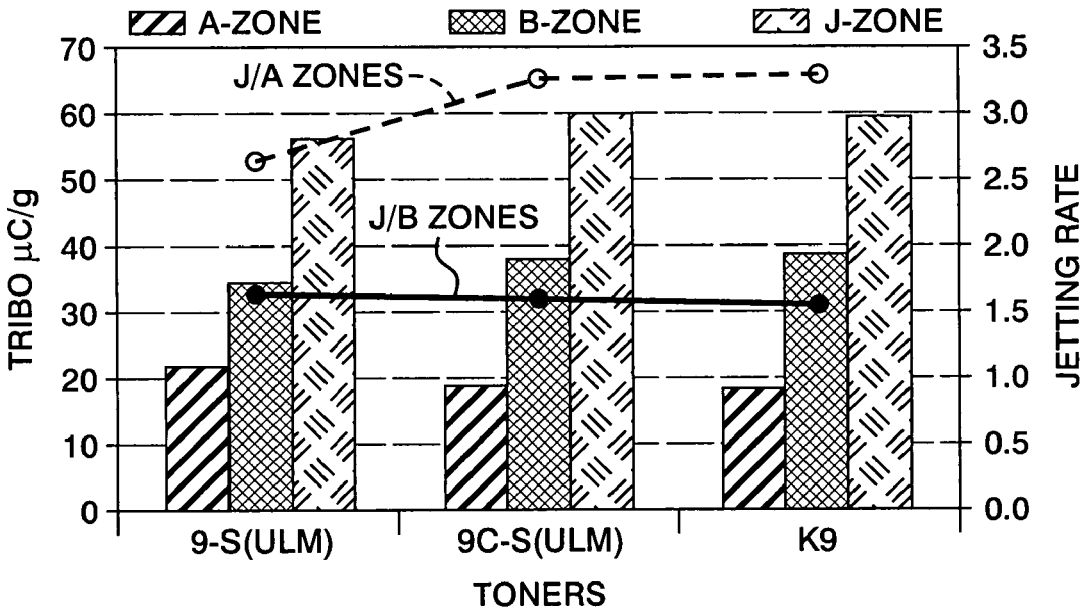
FIG. 3 illustrates the tribo-charging performance over different humidity and temperature zones of the standard K9 toner compared to an ULM IGEN3 toner blend with an embrittling agent.

Addition of the embrittling agent to the IGEN3 toner had no adverse effect on xerographic performance. Bench characterization of the toner showed that charging properties of a black crystalline polyester blended IGEN3 with the embrittling agent added were comparable to the K9 standard. Admix performance of the standard K9 toner compared to an embrittling agent crystalline polyester IGEN3 toner blend also demonstrated comparable results. The embrittling agent shows no adverse effect on other aspects of xerographic reproduction such as fusing performance. Tribo-charging performance over different humidity and temperature zones of the standard K9 toner compared to an embrittling agent crystalline polyester IGEN3 toner blend is shown in FIG. 3.

TABLE 4

Formulation used in charging characterization of embrittling agent cyrstalline polyester IGEN3 toner blend

| Parent Toner | | 9-S ULM A3C Toner | |
|---|---|---|---|
| Resin | Wgt % | Resin | Wgt % |
| XP777H | 50 | NA50HS | 4.2 |
| LEX02 | 17 | SMT5103 | 0.9 |
| CPES-A3C | 20 | H2050 | 0 |
| FTR2120 | 8 | ZnSt-L | 0.5 |
| R330 | 5 | | |

A comparison of a control yellow IGEN3 toner, Y9, to the toners listed in Table 3 further demonstrated that the addition of embrittling agents to IGEN3 toner also had no adverse effect on color performance.

What is claimed is:

1. A process of making toner comprising:

a) mixing a styrene butadiene binder, at least one colorant and at least one embrittling agent to form a mixture, the embrittling agent consisting of a modified or unmodified hydrocarbon resin selected from the group consisting of:

a phenol-modified hydrocarbon resin in flaked form having a softening point of 140° C., a specific gravity at 25° C. of 1.078, a color Gardner of 12, an acid number of <1, a flash point ° F. of 520, an iodine number of 130, a viscosity at 25° C. of 6 Pa·s as determined in accordance with ASTM D-1545, a hydroxyl value of 39 and a number average molecular weight of 655, and a thermoplastic hydrocarbon resin in flaked form manufactured by polymerization of cycloaliphatic and alkyl aromatic monomers and having a softening point of 120° C., a density at 25° C. of 1.06 g/cm$^3$, a color Gardner of 8.5, an iodine number of 39, and an acid value of <1;

b) extruding the mixture; and c) grinding the extruded mixture to form toner particles having an average particle size of from about 3 microns to about 13 microns.

2. The process of claim 1, wherein the at least one colorant is a pigment selected from the group consisting of carbon black, magnetite, and mixtures thereof.

3. The process of claim 1, further including a resin, a liquid, or a solvent in mixing in step (a).

4. The process of claim 1, wherein the at least one embrittling agent increases the grinding rate of the toner particles by about 10 percent to about 100 percent more than that of similar toner particles without the embrittling agent.

5. The process of claim 1, wherein the embrittling agent is present in the toner particles in an amount of from 1 percent to about 20 percent by weight.

6. The process of claim 5, wherein the embrittling agent is present in the toner particles in an amount of from about 4 percent to about 15 percent by weight.

7. The process of claim 1, wherein the embrittling agent is present in the toner particles in an amount of from about 6 percent to about 10 percent by weight.

8. The process of claim 1, wherein the mixing step further includes adding one or more additives to form the mixture, wherein the additive is selected from the group consisting of a charge carrier additive, a surfactant, an emulsifier, and a flow additive.

9. A process of making toner comprising:

a) mixing at least one binder, a crystalline polyester, at least one colorant, and at least one embrittling agent to form a mixture;

b) grinding the mixture to form a generally uniform average toner particle size distribution having a toner average particle size of from about 3 microns to about 13 microns; and c) classifying the ground toner particles, wherein the embrittling agent is a modified or unmodified hydrocarbon resin selected from the group consisting of:

a phenol-modified hydrocarbon resin in flaked form having a softening point of 140° C., a specific gravity at 25° C. of 1.078, a color Gardner of 12, an acid number of <1, a flash point ° F. of 520, an iodine number of 130, a viscosity at 25° C. of 6 Pa·s as determined in accordance with ASTM D-1545, a hydroxyl value of 39, and a number average molecular weight of 655, and a thermoplastic hydrocarbon resin in flaked form manufactured by polymerization of cycloaliphatic and alkyl aromatic monomers and having a softening point of 120° C., a density at 25° C. of 1.06 g/cm$^3$, a color Gardner of 8.5, an iodine number of 39, and an acid value of <1.

10. The process of claim 9, wherein the at least one colorant is selected from the group consisting of a pigment, a dye and mixtures thereof.

11. The process of claim 9 further including a resin, a liquid, or a solvent in mixing in step (a).

12. The process of claim 9, wherein the embrittling agent increases a grinding rate of the toner by about 10 percent to about 100 percent as compared to a toner without the embrittling agent.

13. A toner comprising:

a styrene butadiene binder;

at least one colorant; and an embrittling agent, the embrittling agent consisting of a modified or unmodified hydrocarbon resin selected from the group consisting of:

a phenol-modified hydrocarbon resin in flaked form having a softening point of 140° C., a specific gravity at 25° C. of 1.078, a color Gardner of 12, an acid number of <1, a flash point ° F. of 520, an iodine number of 130, a viscosity at 25° C. of 6 Pa·s as determined in accordance with ASTM D-1545, a hydroxyl value of 39, and a number average molecular weight of 655, and a thermoplastic hydrocarbon resin in flaked form manufactured by polymerization of cycloaliphatic and alkyl aromatic monomers and having a softening point of 120° C., a density at 25° C. of 1.06 g/cm$^3$, a color Gardner of 8.5, an iodine number of 39, and an acid value of <1.

14. The toner of claim 13, wherein the at least one colorant is a pigment selected from the group consisting of carbon black, magnetite, and mixtures thereof.

15. The toner of claim 13, wherein the embrittling agent is present in the toner particles in an amount of from 1 percent to about 20 percent by weight.

16. The toner of claim 13, wherein the average size of the toner particles is from about 4 microns to about 14 microns.

17. The toner of claim 13 further including an additive selected from the group consisting of a charge carrier, a surfactant, an emulsifier, a pigment dispersant, and a flow additive.

18. A toner comprising:

at least one binder;

a crystalline polyester;

at least one colorant; and an embrittling agent, the embrittling agent being a modified or unmodified hydrocarbon resin selected from the group consisting of:

a phenol-modified hydrocarbon resin in flaked form having a softening point of 140° C., a specific gravity at 25° C. of 1.078, a color Gardner of 12, an acid number of <1, a flash point ° F. of 520, an iodine number of 130, a viscosity at 25° C. of 6 Pa·s as determined in accordance with ASTM D-1545, a hydroxyl value of 39, and a number average molecular weight of 655, and a thermoplastic hydrocarbon resin in flaked form manufactured by polymerization of cycloaliphatic and alkyl aromatic monomers and having a softening point of 120° C., a density at 25° C. of 1.06 g/cm$^3$, a color Gardner of 8.5, an iodine number of 39, and an acid value of <1.

19. The toner of claim 18, wherein the at least one colorant is selected from the group consisting of cyan, magenta, yellow, blue, green, red, orange, violet, brown, and mixtures thereof.

20. The toner of claim 18, wherein the embrittling agent increases the grinding rate of the toner from about 10 percent to about 100 percent as compared to a toner without the embrittling agent.

21. The toner of claim 18, wherein the embrittling agent is present in the toner particles in an amount of from 1 percent to about 20 percent by weight.

22. The toner of claim 18 further including an additive selected from the group consisting of a charge carrier, a surfactant, an emulsifier, a pigment dispersant, and a flow additive.

* * * * *